US007967223B2

(12) United States Patent
Cooke

(10) Patent No.: US 7,967,223 B2
(45) Date of Patent: Jun. 28, 2011

(54) FUEL INJECTOR

(75) Inventor: Michael Peter Cooke, Gillingham (GB)

(73) Assignee: Delphi Technologies Holdings S.arl, Troy, MI (US)

( * ) Notice: Subject to any disclaimer, the term of this patent is extended or adjusted under 35 U.S.C. 154(b) by 262 days.

(21) Appl. No.: 12/287,892

(22) Filed: Oct. 14, 2008

(65) Prior Publication Data

US 2009/0277423 A1 Nov. 12, 2009

(30) Foreign Application Priority Data

Oct. 18, 2007 (EP) ..... 07254143

(51) Int. Cl.
*B05B 1/30* (2006.01)

(52) U.S. Cl. ..... 239/585.1; 239/585.5

(58) Field of Classification Search ..... 239/585.1, 239/585.2, 585.3, 585.4, 585.5, 102.2, 584, 239/533.2, 533.9, 533.12; 251/127, 129.15, 251/129.21

See application file for complete search history.

(56) References Cited

U.S. PATENT DOCUMENTS 6,494,383 B2 * 12/2002 Augustin ..... 239/124
6,997,166 B2 * 2/2006 Stringfellow ..... 123/467

FOREIGN PATENT DOCUMENTS

| | | |
|---|---|---|
| DE | 10 2004 015 746 | 10/2005 |
| EP | 0 647 780 | 4/1995 |
| EP | 1 313 940 | 5/2003 |
| EP | 1 650 427 | 4/2006 |

OTHER PUBLICATIONS

European Search Report dated Mar. 14, 2008.

* cited by examiner

*Primary Examiner* — Davis Hwu
(74) *Attorney, Agent, or Firm* — Thomas N. Twomey

(57) ABSTRACT

A fuel injector for use in an internal combustion engine comprises a first valve member and a second valve member, an injection control chamber for fuel, and a set of nozzle outlets; wherein actuation of the second valve member controls the fuel pressure within the injection control chamber, and actuation of the first valve member is regulated by the fuel pressure within the injection control chamber; and wherein the fuel injector is arranged such that actuation of the second valve member establishes a fuel flow path between the injection control chamber and the set of nozzle outlets. The first valve member may be provided with a first valve bore within which the second valve member is received. An injection nozzle and a method of operating a fuel injector are also described.

17 Claims, 9 Drawing Sheets

FUEL INJECTOR

FIELD OF THE INVENTION

The invention relates to a fuel injector for use in the delivery of fuel to a combustion space of an internal combustion engine. In particular, the invention relates to a fuel injector of the type intended for use in a fuel system of the accumulator or common rail type; the injector may be controlled using a solenoid or a piezoelectric actuator arrangement.

BACKGROUND OF THE INVENTION

In an internal combustion engine, it is known for a fuel pump to supply fuel to a high-pressure accumulator (or common rail), from which it is delivered into each cylinder of the engine by means of a dedicated fuel injector. Typically, a fuel injector has an injection nozzle which is received within a bore provided in a cylinder head of the cylinder; and a valve needle which is actuated to control the release of high-pressure fuel into the cylinder from spray holes provided in the nozzle.

Historically common rail fuel injectors have opened and closed the needle by way of a hydraulic servo mechanism (e.g. a power assistance), such as that described in EP 0647780 or EP 0740068.

A solenoid-actuated hydraulic servo fuel injector such as that of EP 0740068 is illustrated in FIG. 1. The fuel injector 1 comprises a valve body 3 defining a blind bore 5 that terminates at a nozzle region 7; and an elongate valve needle 9 having a tip region 11 that is slidable within the bore 5, such that the tip 11 can engage and disengage a valve seat 13 defined by an inner surface of the nozzle 7. The nozzle 7 is provided with one or more apertures (or spray holes; not shown) in communication with the bore 5. Engagement of the tip 11 with the valve seat 13 prevents fluid escaping from the valve body 3 through the apertures, and when the tip 11 is lifted from the valve seat 13, fluid may be delivered through the apertures into an associated engine cylinder (not shown).

The valve needle 9 is shaped such that the region that extends between the gallery 15 and the nozzle 7 is of smaller diameter than the bore 5 to permit fluid to flow between the valve needle 9 and the inner surface of the valve body 3. An annular gallery 15 is provided within the valve body 3. The gallery 15 communicates with a fuel supply line 17 arranged to receive high-pressure fuel from an accumulator of an associated fuel delivery system. In order to permit fuel to flow from the gallery 15 towards the nozzle 7, the valve needle 9 is provided with a fluted region 19 which also acts to restrict lateral movement of the valve needle 9 within the valve body 3.

A chamber 21 is provided within the valve body 3 at a position remote from the nozzle 7, the chamber 21 communicating with the high-pressure fuel line 17 through a restrictor 23. The chamber 21 is closed by a plate 25. The end of the valve needle 9 remote from the tip 11, is provided with a reduced diameter projection 27, the projection 27 guiding a compression spring 29 which is engaged between the valve needle 9 and the plate 25 to bias the valve needle 9 to a position in which the tip 11 engages the valve seat 13.

A body 31 engages the side of the plate 25 opposite that engaged by the valve body 3, the body 31 and plate 25 together defining a chamber 33 which communicates with the chamber 21 through an aperture 35. The body 31 is provided with a bore within which a valve member 37 is slidable. The valve member 37 comprises a cylindrical rod provided with an axially extending blind bore, the open end of the bore being able to communicate with the chamber 33 when the valve member 37 is lifted such that the end thereof is spaced from the plate 25, such communication being broken when the valve member 37 engages the plate 25. A pair of radially extending passages 39 communicate with the blind bore adjacent the blind end thereof, the passages 39 communicating with a chamber which is connected to a suitable low pressure drain.

The body 31, plate 25 and valve body 3 are mounted on a nozzle holder 41 by means of a cap nut 43. The nozzle holder 41 includes a recess within which a solenoid actuator 45 is provided.

The valve member 37 carries an armature such that upon energisation of the solenoid actuator 45, the armature and valve member 37 are lifted so that the valve member 37 disengages the plate 25. On de-energising the solenoid actuator 45, the valve member 37 returns to its original position under the action of a spring 47.

In use, the valve needle 9 is biased by the spring 29 such that the tip 11 engages the valve seat 13 and, thus, delivery of fuel from the apertures does not occur. In this position, the pressure of fuel within the chamber 21 is high, and hence the force acting against the end of the valve needle 9 due to the fuel pressure, and also due to the resilience of the spring 29 is sufficient to overcome the upward force acting on the valve needle 9 due to the high pressure fuel acting against the angled surfaces of the valve needle 9.

In order to lift the tip 11 of the valve needle 9 away from the valve seat 13 to permit fuel to be delivered from the apertures, the solenoid actuator 45 is energised to lift the valve member 37 against the action of the spring 47 such that the end of the valve member 37 is lifted away from the plate 25. The lifting of the valve member 37 permits fuel from the chamber 33 and hence the chamber 21 to escape to drain through the bore of the valve member 37 and passages 39. The escape of fuel from the chamber 21 reduces the pressure therein, and due to the provision of the restrictor 23, the flow of fuel into the chamber 21 from the fuel supply line 17 is restricted. As the pressure within the chamber 21 falls, a point will be reached at which the force applied to the valve needle 9 due to the pressure within the chamber 21 in combination with that applied by the spring 29 is no longer sufficient to retain the tip 11 of the valve needle 9 in engagement with the valve seat 13, and hence a further reduction in pressure within the chamber 21 will result in the valve needle 9 being lifted to permit fuel to be delivered from the apertures. Typically, a 20% reduction in pressure within the chamber 21 is sufficient to cause the tip 11 of the valve needle 9 to lift from the valve seat 13 and for a fuel injection from the apertures to commence.

In order to terminate delivery, the solenoid actuator 45 is de-energised and the valve member 37 moves downwards under the action of the spring 47 until the open end engages the plate 25. This movement of the valve member 37 breaks the communication between the chamber 33 and the drain and, hence, the pressure within the chamber 33 and chamber 21 will increase. Eventually a point is reached at which the force applied to the valve needle 9 due to the pressure within the chamber 21 and the spring 29 exceeds that tending to open the valve needle 9, and the valve needle 9 will then move to a position in which the tip 11 engages the valve seat 13 to prevent further delivery of fuel.

A solenoid-actuated hydraulic servo mechanism such as that of FIG. 1 means that a low force control valve 37 can be used to switch the high forces on the valve needle 9. With low forces on the control valve 37, a relatively inexpensive and simple solenoid can give a suitably fast enough response in the injector for most purposes. However, a number of disadvantages are associated with the design of such servo injector mechanisms. In this regard, prior art servo designs are subject to a lag period between energization of the solenoid and commencement of the fuel injection event, during which a parasitic flow of fuel is channeled to a low-pressure fuel drain. Therefore, a hydraulic servo injector cannot always be made to commence a fuel injection event as quickly as may be desired. Moreover, the faster the response desired, the higher the fuel flows required for the hydraulic servo and the higher the resulting parasitic losses from the servo mechanism. The parasitic fuel flow also undesirably returns heat to the fuel supply.

More recently some injectors have used a piezoelectric actuator to directly move the needle (e.g. EP 0995901; EP 1174615). These designs eliminate both the parasitic losses from the servo flows and the time delays in the servo. Some of them also have an accumulator volume within the injector, which ensures that maximum pressure is available at the nozzle seat and that wave activity (which could interfere with multiple injections) is minimised.

As illustrated in FIG. 2, a known piezoelectrically actuated fuel injector may comprise a valve body 3 having a blind bore 5 extending into a nozzle region 7 provided with a plurality of apertures (or fuel spray holes; not shown); and a valve needle 9 reciprocable within the bore 5 between injecting and non-injecting positions, as previously described. A piezoelectric actuator stack 49 is operable to control the position occupied by a control piston 51, the piston 51 being moveable to control the fuel pressure within a control chamber 53 defined by a surface associated with the valve needle 9 of the injector and a surface of the control piston 51. The piezoelectric actuator stack 49 comprises a stack of piezoelectric elements, the energisation level, and hence the axial length, of the stack being controlled by applying a voltage across the stack. Upon de-energisation of the piezoelectric stack 49, the axial length of the stack is reduced and the control piston 51 is moved in a direction which causes the volume of the control chamber 53 to be increased, thereby causing fuel pressure within the control chamber 53 to be reduced. The force applied to the valve needle 9 due to fuel pressure in the control chamber 53 is thus reduced, causing the valve needle 9 to lift away from a valve needle seating (not shown) under the influence of high-pressure fuel on surfaces of the valve needle 9, so as to permit fuel delivery into an associated engine cylinder via one or more apertures (or spray holes; not shown).

In order to cause initial movement of the valve needle 9 away from its seating, a relatively large retracting force must be applied to the valve needle 9 to overcome the downwards (closing) force on the valve needle 9. Typically, the large retracting force applied to the valve needle 9 is maintained throughout the opening movement, until the valve needle 9 reaches its full lift position. However, in theory, once valve needle 9 movement has been initiated, a reduced force is sufficient to cause continued movement of the valve needle 9 towards its full lift position. Hence, many known fuel injectors of this type are relatively inefficient as a significant amount of energy is wasted in applying a large retracting force to the valve needle 9 throughout its full range of movement.

To terminate a fuel injection event, the stack 49 is returned to its initial energisation state, and as a result, the piston 51 also returns substantially to its initial position thereby reducing the volume of the control chamber 53. The consequential increase in fuel pressure within the control chamber 53 applies an increased closing force on the valve needle 9, and a point is eventually reached at which the fuel pressure within the control chamber 53 in conjunction with the spring 29 is sufficient to return the needle 9 into engagement with the valve seating (not shown).

In the piezoelectric fuel injector illustrated in FIG. 2, the control piston 51 is part of a hydraulic amplifier system situated between the actuator stack 49 and the needle 9, such that axial movement of the actuator 49 results in an amplified axial movement of the needle 9. In contrast to the fuel injector illustrated in FIG. 2, some piezoelectrically-actuated fuel injectors may be of the type in which energisation (rather than de-energisation) of the piezoelectric stack is required to initiate a fuel injection event.

In addition to the potential faster injector response time of the piezoelectrically operated valve, a further benefit of using a piezoelectric actuator for direct control over the movement of a valve needle is that the axial length of the piezoelectric stack can be variably controlled by changing the amount of electrical charge stored on the piezoelectric stack and, therefore, it is possible to control the position of the valve needle relative to the valve seat. In this way, piezoelectric fuel injectors offer greater ability to meter the amount of fuel that is injected.

However, a number of disadvantages of direct-acting piezoelectric fuel injectors are also apparent. For example, one problem with these direct acting designs is that a relatively large and expensive piezoelectric actuator is needed to provide the energy needed to lift the needle. Furthermore, this type of actuator needs to get larger and/or more efficient as nozzle flow requirements and pressures increase. Another consideration with respect to large fuel injections is that the amount of needle lift is limited by the capabilities of the actuator (even if a hydraulic amplifier is used to try to alleviate this problem).

The invention relates to a fuel injector and to a method for operating a fuel injector so as to overcome or at least alleviate at least one of the above-mentioned problems in the prior art.

SUMMARY OF THE INVENTION

In broad terms, the invention provides a fuel injector and a method for operating a fuel injector that achieve benefits of direct-acting and hydraulic servo fuel injector designs, while reducing disadvantages associated with such known systems. In part, the invention provides a fuel injector that provides the advantages of a direct-acting fuel injector, but at a lower cost and without the limitations on fuel pressure and fuel flow rate. The invention further relates to a fuel injector and a method for operating a fuel injector in which the parasitic servo flow of fuel associated with prior art servo mechanisms is injected into an engine cylinder, rather than being returned to the fuel supply. In part the invention relates to a fuel injector having two valve needles, the position of one of the valve needles being controlled directly by way of an actuating mechanism, and the position of the other being controlled indirectly by way of a servo flow. In this way, one or more advantages over the prior art may be achieved, for example: the servo flow is no-longer parasitic as it is injected; servo flows can be relatively large as they are doing useful work, so response speed can be high; no back-leak connection to the fuel supply is required on the injector and no heat is returned to the fuel supply; small injections are controlled directly and so are not subject to servo lags; needle lift for large injections is not limited by actuator capabilities.

Accordingly, in a first aspect the invention provides a fuel injector for use in an internal combustion engine, the fuel injector comprising a first and a second valve member, an injection control chamber for fuel, and a set of nozzle outlets;

wherein actuation of the second valve member controls the fuel pressure within the injection control chamber, and actuation of the first valve member is regulated by the fuel pressure within the injection control chamber; and wherein the fuel injector is arranged such that actuation of the second valve member establishes a fuel flow path between the injection control chamber and the set of nozzle outlets.

Accordingly, in contrast to prior art servo-controlled fuel injectors, fuel from the injection control chamber may be advantageously injected into an associated engine cylinder, rather than being channeled to a low-pressure fuel reservoir.

In one embodiment, the first valve member is responsive to fuel pressure within the injection control chamber and is arranged to control fuel delivery through a set of nozzle outlets; the second valve member is responsive to an actuator and is also arranged to control fuel delivery through a set of nozzle outlets. In this way, both the first and second valve members are associated with a set of nozzle outlets, which may be the same or different.

It will be understood that by the term "nozzle outlets" it is meant the holes (or apertures) through which fuel is injected from the injection nozzle of the fuel injector and into an associated engine cylinder (in use), which may also be referred injection holes, spray holes or similar terms known in the art. By "a set of nozzle outlets" it is meant the one or more nozzle outlets through which fuel is injected when a particular valve member is disengaged from an associated seating region. Thus, in the context of the invention, each valve member is associated with a seating region and an associated "set" of nozzle outlets. Where there are more than one valve members (e.g. two), each valve member is associated with a set of nozzle outlets, which may be the same or different. Suitably, the set of nozzle outlets associated with the first valve member is different to the set of nozzle outlets associated with the second valve member. Were a valve member to have more than one associated seating region (e.g. two), each seating region is associated with a set of nozzle outlets that may be the same or different. A "set" may include only one nozzle outlet. Generally, however, by a "set" it is meant more than one nozzle outlet, for example, between 2 and 12, between 3 and 10, or between 4 and 8; such as 4, 5, 6, 7 or 8.

In an advantageous embodiment of the invention, the fuel injector may further comprise: an injection nozzle; a nozzle body provided with a nozzle bore; the first valve member being received within the nozzle bore and being engageable with a first seating region to control fuel delivery through a first set of nozzle outlets; a first surface associated with the first valve member which defines a wall of the injection control chamber; the second valve member being engageable with a second seating region to control fuel delivery through a second set of nozzle outlets; and an actuator for controlling the position of the second valve member relative to the second seating region; wherein the fuel injector is arranged such that fuel delivery through the second set of nozzle outlets is controlled by the actuator, and fuel delivery through the first set of nozzle outlets is controlled by the fuel pressure within the injection control chamber.

Thus, in a second aspect of the invention there is provided a fuel injector for use in an internal combustion engine, the fuel injector comprising: an injection nozzle; a nozzle body provided with a nozzle bore; an injection control chamber for fuel; a first valve member being received within the nozzle bore and being engageable with a first seating region to control fuel delivery through a first set of nozzle outlets; a first surface associated with the first valve member and defining a wall of the injection control chamber; a second valve member being engageable with a second seating region to control fuel delivery through a second set of nozzle outlets; and an actuator for controlling the position of the second valve member relative to the second seating region; wherein the fuel injector is arranged such that fuel delivery through the second set of nozzle outlets is controlled by the actuator, and fuel delivery through the first set of nozzle outlets is controlled by the fuel pressure within the injection control chamber.

The first valve member conveniently has a second surface that communicates with fuel at injection pressure, and the injector is arranged such that engagement of the first valve member with its associated seating region prevents the injection of this fuel at injection pressure. Conveniently, an annular gallery is provided within the nozzle body. The annular gallery is arranged about a section of the first valve member, in use, to communicate with a fuel supply line for delivering high-pressure fuel (i.e. fuel at injection pressure) from an accumulator of an associated fuel delivery system to the fuel injector. The annular gallery may be defined as an annular volume between the second (outer) surface of the first valve member and the (inner surface of the) nozzle body. In order to permit fuel to flow from the annular gallery towards the tip of the first valve member and its associated seating region, the first valve member is suitably a clearance fit within the nozzle bore. Alternatively or additionally, the (outer) surface of the first valve member may be provided with a fluted region to define one or more channels between the nozzle bore and the first valve member.

In use of the fuel injector of the invention, fuel from the injection control chamber is delivered through the second set of nozzle outlets causing the fuel pressure within the injection control chamber to reduce, and when the pressure of fuel within the injection control chamber has reduced to a predetermined low pressure, the first valve member is caused to disengage the first seating region to allow delivery of fuel through the first set of nozzle outlets. The predetermined low pressure can be any suitable pressure, which is typically determined during engine design according to specified requirements. The fuel injector is manufactured in such a way that the first valve member is biased against (i.e. it engages) the first seating region when the injection control chamber contains a predetermined relatively high fuel pressure, and is biased away from (i.e. it disengages) the first seating region when there is a predetermined relatively lower fuel pressure in the injection control chamber.

Actuation of the first valve member is, thus, controlled by the balance between the opposing forces acting on the first and second surfaces of the first valve member. In this regard, fuel at injection pressure acts on the second surface tending to bias the first valve member away from its seating region; while fuel pressure in the injection control chamber acts on the first surface, tending to bias the first valve member towards its seating region. Typically, an additional biasing arrangement is employed to increase the biasing force on the first valve member in the direction of its seating region. Conveniently, the biasing arrangement is a spring; the spring may be arranged within the injection control chamber so that it exerts a force on the first surface of the first valve member in the direction of the injection nozzle tip and the first valve seating region.

In particularly suitable embodiments, the first valve member is provided with a first valve bore, and the second valve member is received within the first valve bore. The first valve bore provides a path of fluid communication (for fuel) between the injection control chamber and a set of nozzle outlets associated with the second valve member. Advantageously, the first valve bore extends along the central axis of the first valve member. The second valve member is suitably a clearance fit within the bore, in use to permit fuel from the injection control chamber to pass between the (inner) surface of the first valve bore and the (outer surface of the) second valve member towards the tip of the second valve member. Thus, engagement of the second valve member with its associated (second) seating region prevents the injection of fuel from the injection control chamber (via the fluid communication path between the bore of the first valve member and the second valve member).

The fuel injector of the invention may comprise a second valve seat member which has a surface defining the second seating region associated with the second valve member. In a beneficial embodiment the second valve seat member is arranged to substantially prevent fluid communication between the first set of nozzle outlets and the second set of nozzle outlets, where the first and second valve members control the injection of fuel from separate sets of nozzle outlets. In another embodiment, however, the second valve seat may be adapted to enable fluid communication between the first valve bore and the set of nozzle outlets associated with the first valve member when the second valve member is disengaged from the second seating region. In this way, the first and second valve members may control the injection of fuel through the same set of nozzle outlets. Advantageously, the second valve seat is arranged as a guide for the first valve member. Thus, at least a part of the second valve seat is a close fit with the first valve bore in the region of the tip of the first valve member.

In some embodiments, the second valve member may be coupled to the actuator via a pressure control valve, the pressure control valve being adapted to provide a fuel flow path between the injection control chamber and an accumulator volume advantageously provided within the nozzle body. In one embodiment, the pressure control valve comprises a control piston provided with a restricted flow passage, wherein the restricted flow passage fluidly connects the injection control chamber to the accumulator volume. Conveniently, the restricted flow passage fluidly connects with a bore provided within the pressure control valve to fluidly connect the accumulator volume with the injection control chamber.

The control piston may be further provided with a non-restricted flow passage for fluidly connecting the injection control chamber to the accumulator volume.

In one embodiment, the control piston is engageable with a piston seating region provided within the accumulator volume to provide a mechanism for controlling fuel delivery from the accumulator volume to the injection control chamber via the non-restricted flow passage. Conveniently, the fuel injector is arranged such that actuation of the second valve member is required for the control piston to engage the piston seating region and close the non-restricted flow passage. In some embodiments, actuation of the second valve member causes the control piston to engage the piston seating region (i.e. the non-restricted flow passage is closed for the duration when the second valve member is actuated and closed at other times). In some embodiments, the level of actuation of the second valve member determines whether the control piston engages the piston seating region, such that actuation of the second valve member causes the control piston to approach the piston seating region and the level of actuation of the second valve member influences the extent to which the non-restricted flow passage is open or closed. A piezoelectric actuator may be employed beneficially to achieve such variable levels of actuation.

In accordance with the invention, it is advantageous that the second valve member is controlled by an actuator to allow a relatively rapid movement of the second valve member in response to actuation by the actuator. Thus, the second valve member is conveniently controlled directly by the actuator, meaning that a servo flow or other indirect mechanism for influencing the position of the second valve member is not used. Direct actuation does not exclude the possibility of a coupling arrangement between the second valve member and the actuator.

In an advantageous embodiment, the actuator comprises a solenoid actuator. In this embodiment, the second valve member is suitably coupled to an armature responsive to the energisation state of the solenoid actuator. The armature may be received within the accumulator volume, and is conveniently coupled to the second valve member via the control piston.

In another embodiment, the actuator comprises a piezoelectric actuator. Advantageously, in this embodiment there may be provided a hydraulic coupling between the piezoelectric actuator and the second valve member. In this way the responsiveness (i.e. the extent of translational movement) of the second valve member can be controlled relative to the length change of the piezoelectric actuator, as described in EP 0995901, by way of example. Typically, the hydraulic coupling is adapted to compensate for any slow length changes that may occur in the piezoelectric actuator as a result of variations in factors such as pressure and temperature. In this way, the second valve member is not inadvertently disengaged from its seating region as a result of changes in engine and/or environmental parameters or piezoelectric properties of the actuator. Conveniently, the hydraulic coupling may also (or alternatively) serve to amplify the movement of the piezoelectric actuator so that the second valve member moves a greater distance that the length change of the actuator. Amplification of the movement of the piezoelectric actuator may suitably be achieved by way of a piston member of larger diameter than the second valve member (as shown in FIG. 2).

In an alternative embodiment, the actuator may comprise a magnetostrictive actuator.

In any of the embodiments of the invention, the first valve member may define a spring chamber within the injection control chamber, the spring chamber being arranged to house a spring which in use serves to bias the first valve member towards its associated seating region. Advantageously, the biasing force of the spring is selected to regulate the opening pressure of the first valve member; i.e. the pressure of the fuel in the injection control chamber when the first valve member is caused to disengage its seating region under the action of fuel at injection pressure on the second surface of the first valve member.

In another aspect the invention provides an injection nozzle for use in a fuel injector for an internal combustion engine.

In one embodiment of this second aspect, the invention provides an injection nozzle comprising a first and a second valve member, an injection control chamber for fuel, and a set of nozzle outlets; wherein actuation of the second valve member controls the fuel pressure within the injection control chamber, and actuation of the first valve member is regulated by the fuel pressure within the injection control chamber; and wherein the injection nozzle is arranged such that actuation of the second valve member establishes a fuel flow path between the injection control chamber and the set of nozzle outlets. In this embodiment, the first valve member is responsive to fuel pressure within the injection control chamber and may be arranged to control fuel delivery through a set of nozzle outlets; and the second valve member is responsive to an actuator and is arranged to control fuel delivery through a set of nozzle outlets. In such embodiments, the injection nozzle may further comprise: a nozzle body provided with a nozzle bore; the first valve member being received within the nozzle bore and being engageable with a first seating region to control fuel delivery through a first set of nozzle outlets; a first surface associated with the first valve member which defines a wall of the injection control chamber; the second valve member being engageable with a second seating region to control fuel delivery through a second set of nozzle outlets; and wherein the second valve member is adapted to be responsive to an actuator for controlling the position of the second valve member relative to the second seating region; and wherein the injection nozzle is arranged such that, in use, fuel delivery through the second set of nozzle outlets is controlled by the actuator, and fuel delivery through the first set of nozzle outlets is controlled by the fuel pressure within the injection control chamber.

It will be appreciated by the person skilled in the art that all relevant features of the components of the first aspect and second aspects of the invention may be incorporated within each other and within the third aspect of the invention, where appropriate.

It will be appreciated that a valve "member" may take any appropriate form, and can be conveniently considered to have a "tip" (or tip region) which is adapted to engage with an associated seating region. Typically, the valve member takes the form of a valve "needle", which is generally elongate and cylindrical.

In a fourth aspect the invention relates to a method for operating a fuel injector. Thus, in one embodiment there is provided a method of operating a fuel injector, the method comprising: providing a first injection arrangement for injecting fuel into a cylinder of an engine, the first injection arrangement being controlled by the fuel pressure within an injection control chamber of the fuel injector; and providing pressure regulating apparatus for regulating the pressure of fuel within the injection control chamber; wherein the pressure regulating apparatus comprises a second injection arrangement for injecting fuel from the injection control chamber into a cylinder of an engine. Advantageously, the fuel injector is a fuel injector in accordance with the invention.

The invention also relates to an internal combustion engine having a fuel injector in accordance with the invention therein.

These and other aspects, objects and the benefits of this invention will become clear and apparent on studying the details of this invention and the appended claims.

All references cited herein are incorporated by reference in their entirety. Unless otherwise defined, all technical and scientific terms used herein have the same meaning as commonly understood by one of ordinary skill in the art to which this invention belongs.

BRIEF DESCRIPTION OF THE DRAWINGS

The invention will further be described, by way of example, with reference to the accompanying drawings, in which:

FIG. 5 shows the fuel injector of FIGS. 3 and 4 in a first fuel injecting mode.

FIG. 7 shows the fuel injector of FIGS. 3 and 4 in a third fuel injecting mode.

DETAILED DESCRIPTION OF THE INVENTION

Figure 1:
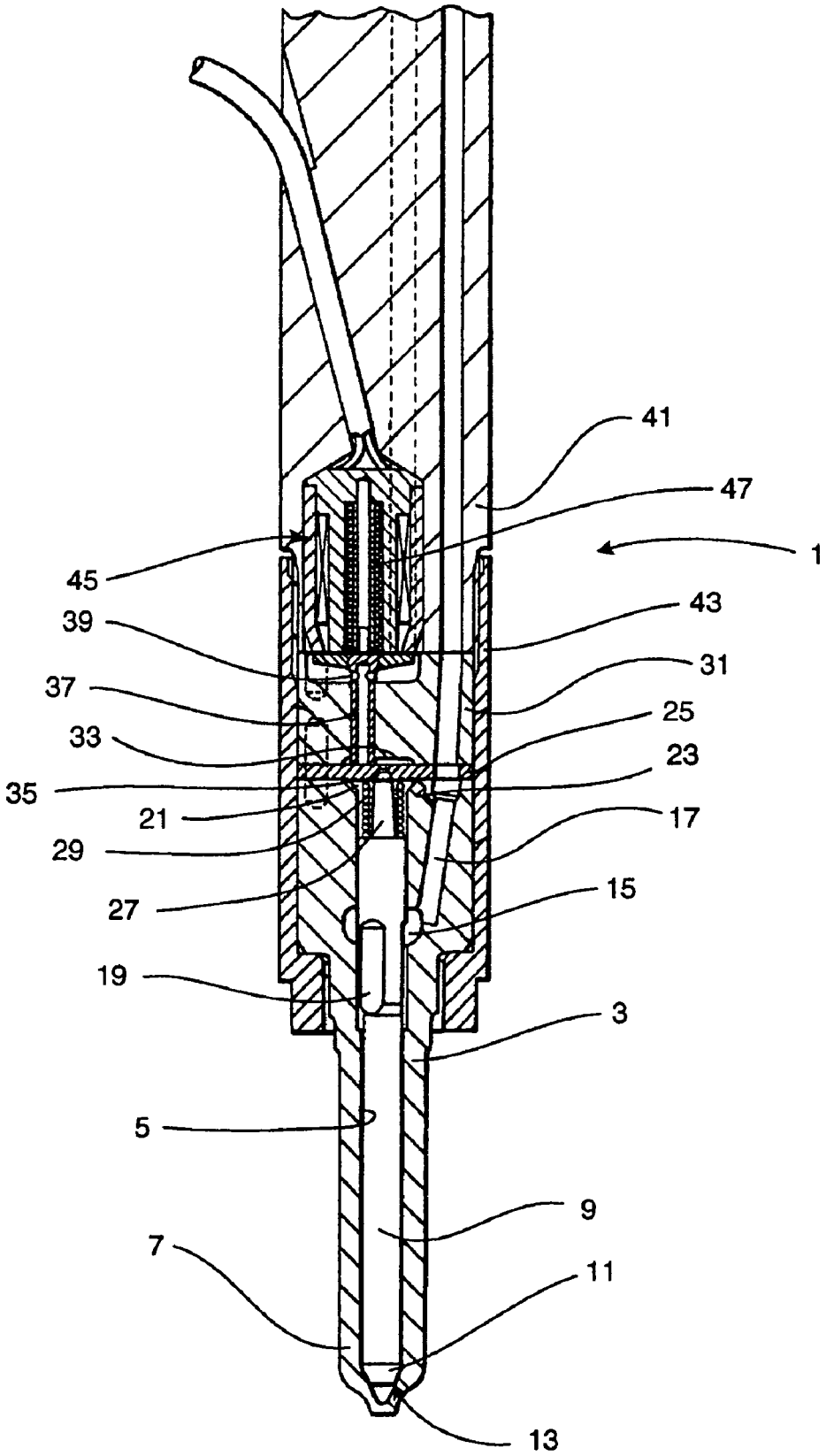
FIG. 1 shows a conventional solenoid-actuated hydraulic servo fuel injector.
Figure 2:
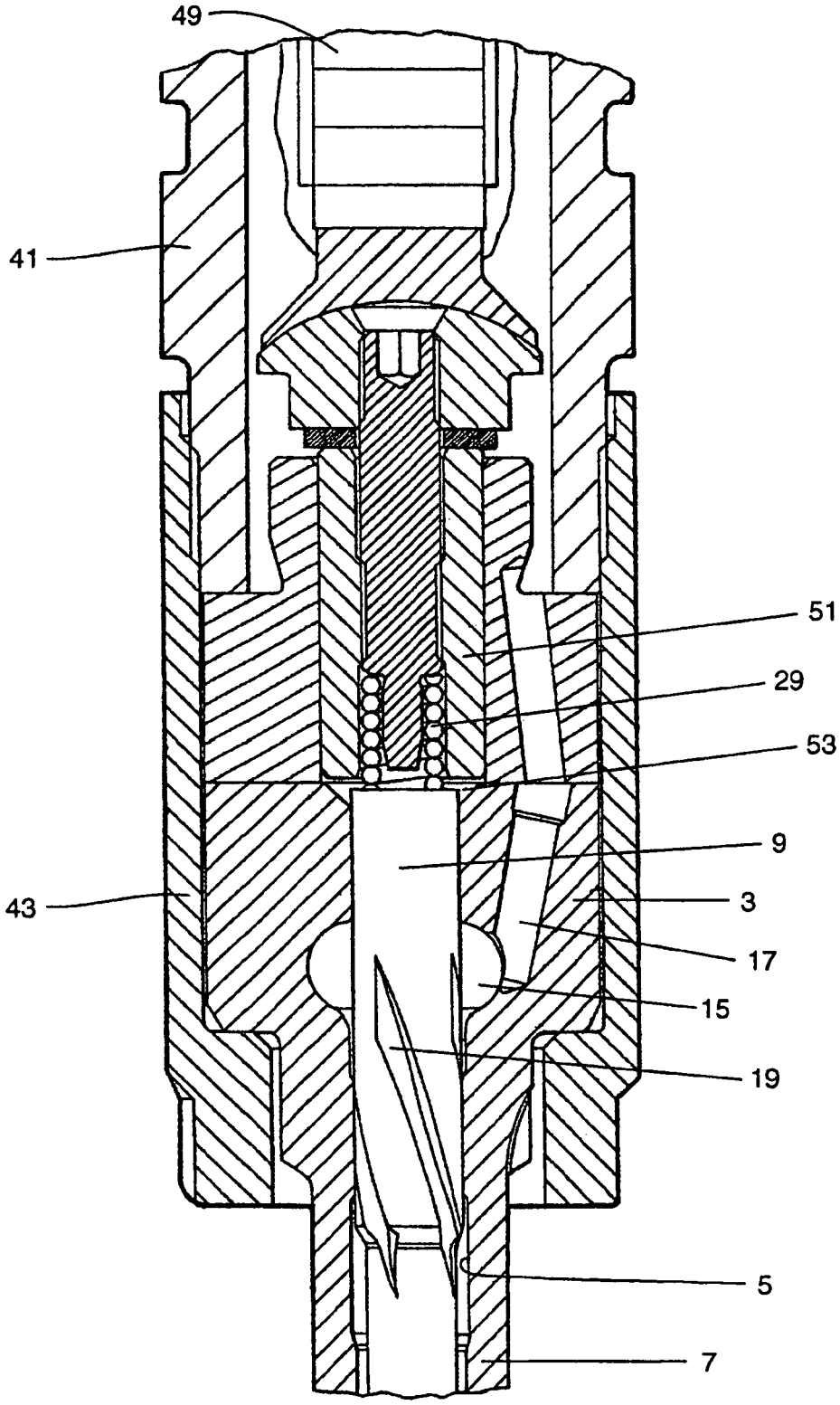
FIG. 2 shows a known piezoelectrically actuated fuel injector.
Figure 3:
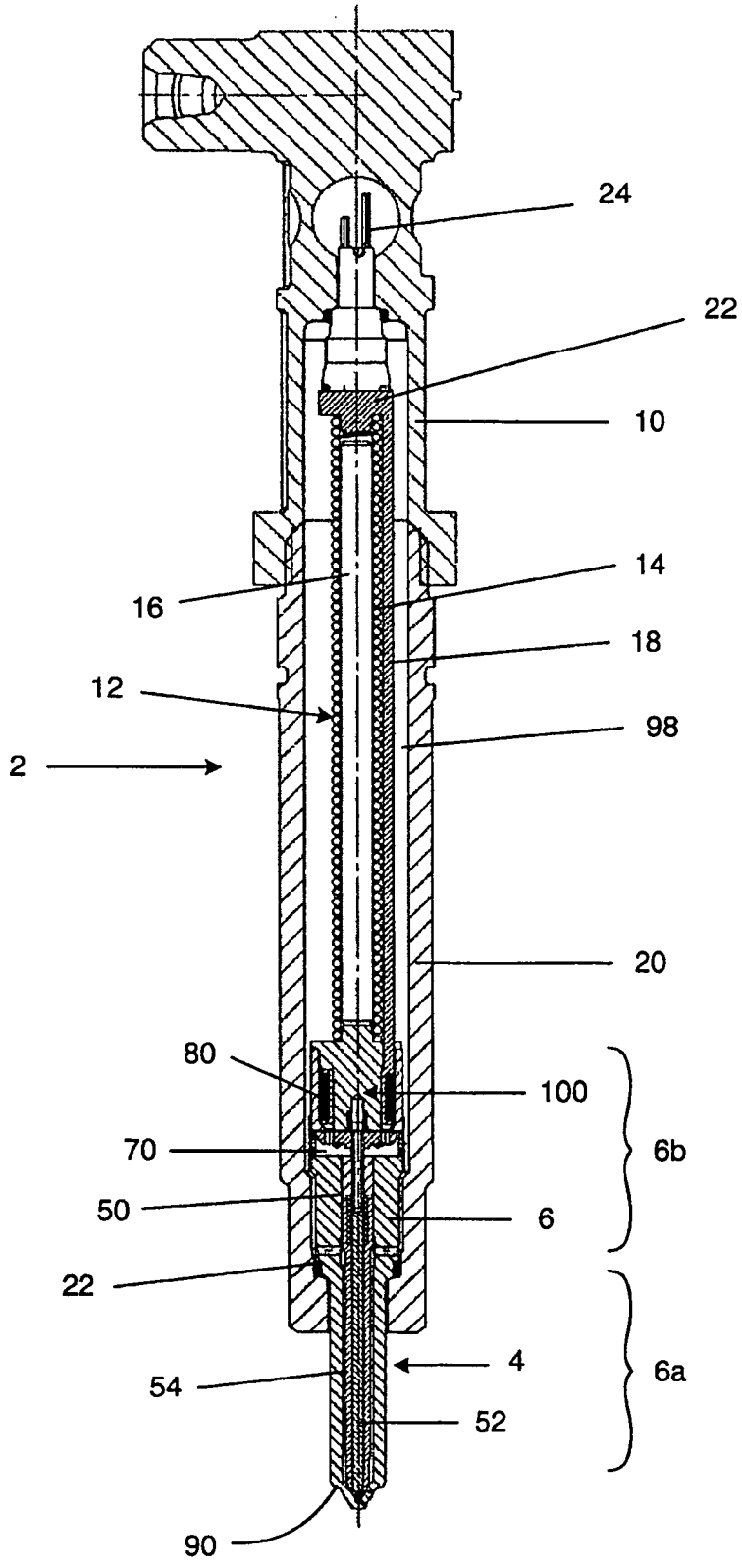
FIG. 3 is a cross-sectional side elevation of one example of a fuel injector in accordance with the invention.
Figure 4:
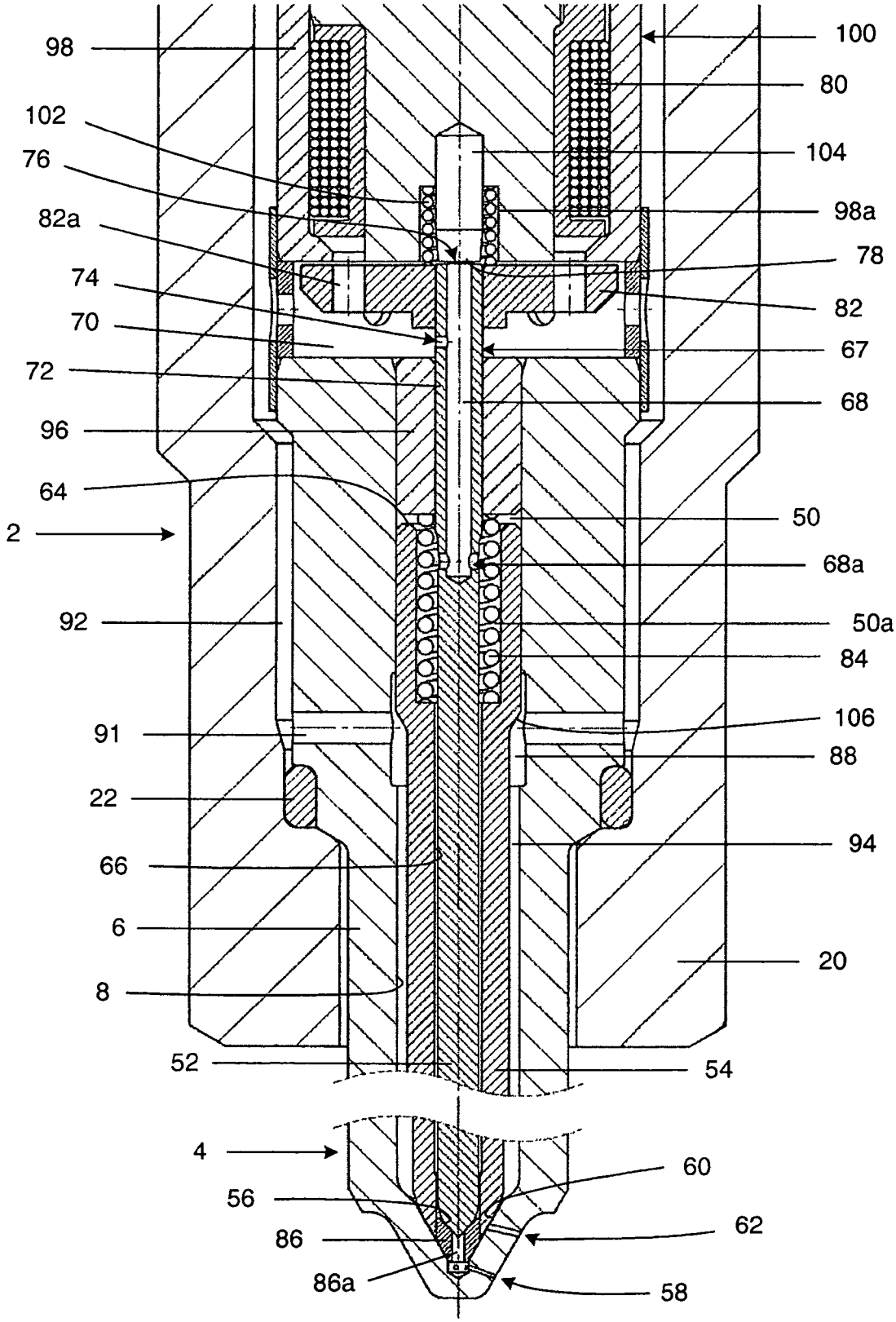
FIG. 4 is an enlarged cross-sectional side elevation of a portion of the fuel injector of FIG. 3.

Referring to FIGS. 3 and 4, a fuel injector 2 comprises an injection nozzle 4, which comprises a nozzle body 6 having a first region 6*a* of relatively small diameter extending towards the nozzle tip 90 and a second region 6*b* of relatively large diameter distal to the nozzle tip 90 (indicated generally in FIG. 3). The nozzle body 6 is provided with an axially extending blind nozzle bore 8, the blind end of which is defined by the nozzle tip 90. Disposed within the nozzle bore 8 is a first valve member 54, in the form of an elongate needle, which is slidable within the nozzle bore 8. The tip region of the first valve member 54 is arranged to be engageable with a first seating region 60, which is defined by the inner surface of the nozzle bore 8 adjacent the blind end of the bore 8. The nozzle body 6 is provided with a first set of nozzle outlets 62 that communicate with the nozzle bore 8 downstream of the first seating region 60, such that: engagement of the first valve member 54 with the first seating region 60 prevents fuel escaping from the nozzle body 6 through the first set of nozzle outlets 62; and disengagement of the first valve member 54 from the first seating region 60 allows fuel to be injected through the first set of nozzle outlets 62.

The nozzle body 6 is further provided with a second set of nozzle outlets 58 that communicate with a first valve bore 66 provided within the first valve member 54 and extending axially therethrough. A second valve member 52 is received within the first valve bore 66 and is a sliding fit therein. In the example depicted, the second valve member 52 is in the form of a generally cylindrical elongate needle having a tip region that is arranged to be engageable with a second seating region 56, which is defined by a second valve seat member 86 located at the blind end of the nozzle bore 8. The fuel injector 2 and injection nozzle 4 are arranged such that engagement of the second valve member 52 with the second seating region 56 prevents fuel escaping from the first nozzle bore 66 through the second set of nozzle outlets 58; and disengagement of the second valve member 52 from the second seating region 56 allows fuel to be injected through the second set of nozzle outlets 58.

As shown in FIG. 4, the second set of nozzle outlets 58 are separated from the first set of nozzle outlets 62 by the second valve seat member 86, which is provided with a through bore 86*a* to allow fluid communication between the first valve bore 66 and the second set of nozzle outlets 58. Conveniently, the second valve seat member 86 is a sliding fit within the first valve bore 66 to serve to guide the tip of the first valve member 54 as it slides towards and away from the first seating region 60. Beneficially, the sliding fit of the second valve seat member 86 within the first valve bore 66 is sufficiently tight to produce a sealing engagement between an inner surface of the first valve bore 66 and an outer surface of the second valve seat member 86, to substantially prevent fluid communication between the first 62 and second 58 set of nozzle outlets. It should, however, be appreciated that in an alternative embodiment the second valve seat member 86 may be adapted to allow fluid communication between the first 62 and second 58 set of nozzle outlets. Alternatively, the second valve seat member 86 may be adapted to provide a fluid communication path either from the second seating region 56 to the first set of nozzle outlets 62, or from the first seating region 60 to the second set of nozzle outlets 62, such that the first 54 and second 52 valve members regulate fuel injection from the same set of nozzle outlets.

As shown more clearly in FIG. 4, the nozzle bore 8 is shaped to define an annular gallery 88 about a section of the first valve member 54, suitably within the second region 6*b* of the nozzle body 6. The annular gallery 88 communicates with a fuel supply line, which is arranged to receive high-pressure fuel from an accumulator of an associated fuel delivery system. In one embodiment, as depicted, the fuel supply line may comprise a drilling 91 and fuel passage 92. In order to permit fuel at injection pressure to flow from the gallery 88 to the first seating region 60, the first valve member 54 is of smaller diameter than the nozzle bore 8 along the section of the first valve member 54 that extends between the annular gallery 88 and the first seating region 60 of the nozzle body 6. In this way, an annular channel 94 for fluid communication is established. In contrast, the section of the first valve member 54 that extends through the second section 6*b* of the nozzle body 6 distally away from the first seating region 60 is of larger diameter, substantially preventing the flow of fluid between the first valve member 54 and the nozzle bore 8 of the nozzle body 6.

In another embodiment, the first valve member 54 may be provided with a fluted region having flutes (not shown) to define fluid flow paths between the annular gallery 88 and the annular channel 94 that communicates with the first seating region 60 and, when the first valve member 54 is disengaged from the first seating region 60, the first set of nozzle outlets 62. The fluted region may in some embodiments also act to restrict lateral movement of the first valve member 54 within the nozzle body 6 while not restricting axial movement.

The surface of the first valve member that defines the inner wall of the annular gallery 88 and the annular channel 94, which is in contact with fuel at injection pressure, may be termed the second surface of the first valve member 54. Beneficially, the first valve member 54 is shaped such that the pressure of the fuel in the annular gallery 88 and/or the annular channel 94 acting on the second surface biases the first valve member 54 away from the first seating region 60. Advantageously, as shown in FIG. 4, the first valve member 54 is shaped so as to define an angled step 106 within the annular gallery 88; the step 106 forming a thrust surface such that fuel within the annular gallery 88 and annular channel 94 (which is conveniently at injection pressure), applies a force to the first valve member 54 urging the it away from its seating region.

The second region 6*b* of the nozzle body 6 is provided with an injection control chamber 50 at a position coinciding with the end of the first valve member 54 distant from the tip of the injection nozzle 4. The injection control chamber 50 is defined between: the end of the first valve member 54 remote from the tip, which may be termed the first surface 64 of the first valve member 54; the nozzle bore 8; and a surface of an end plate 96. The end plate 96 is conveniently a sealing fit within the nozzle bore 8, but could alternatively form part of the second region 6*b* of the nozzle body 6.

The injection nozzle 4 is arranged such that the injection control chamber 50 communicates through a pressure control valve 67 with an accumulator volume 70 that receives high-pressure fuel (e.g. fuel at injection pressure) via a fuel supply line that suitably comprises fuel passage 92. The pressure control valve 67 provides a mechanism for regulating the delivery of fuel from the accumulator volume 70 into the injection control chamber 50, when the pressure of fuel within the injection control chamber 50 is lower than that of the accumulator volume 70. The pressure control valve 67 is adapted to provide a restricted flow path for fuel, which as illustrated in FIG. 4, may comprise a control piston 72 which extends through a bore (e.g. a drilling) in end plate 96, from the injection control chamber 50 to the accumulator volume 70. The control piston 72 is provided with an axial blind bore defining a fuel flow path 68; the fuel flow path 68 communicates with the injection control chamber 50 through radial drilling(s) 68*a*, and with the accumulator volume 70 through a restrictor, conveniently in the form of a restricted flow passage 74. The restricted flow passage 74 conveniently takes the form of an aperture or drilling of relatively small diameter extending radially through the wall of the control piston 72 into the flow path 68.

The pressure control valve 67 may further comprise a non-restricted flow passage 76, the function of which will be described further below. In one embodiment, as depicted, the non-restricted flow passage 76 is formed by an extension of the fuel flow path 68 through the end of the control piston 72 that is received in the accumulator volume 70; the diameter of the flow path 68 being such that the flow of fuel from the accumulator volume 70 to the injection control chamber 50 through the control piston 72 is substantially unrestricted.

The control piston 72 is a sliding fit within the bore of the end plate 96, to allow movement of the control piston therethough, and more suitably, the sliding fit is a sealing fit to substantially prevent the passage of fuel between the control piston 72 and the bore of the end plate 96.

The first surface 64 of the first valve member 54 being exposed to the fuel within the injection control chamber provides a thrust surface against which fuel under pressure may act to urge the first valve member 54 towards its seating 60. The first surface 64 of the first valve member 54 is further shaped to define a spring chamber 50*a* within the injection control chamber 50; the spring chamber 50*a* being adapted to house a spring 84. The spring 84 is adapted to engage within the control chamber 50 and spring chamber 50*a* between the exposed surface of the fixed end plate 96 and the first surface 64 of the first valve member 54, such that it provides an additional biasing force that urges the first valve member 54 against the first seating region 60.

As depicted in FIG. 4, the second valve member 52 may conveniently project into the spring chamber 50*a* such that the spring 84 mounts around the end of the second valve member 52 distant from its tip. The end of the second valve member 52 within the injection control chamber 50 is coupled to the control piston 72, which is responsive to an actuator 100. In the embodiment the control piston 72 and second valve member 52 are rigidly connected with the control piston 72 being in effect a projection of the second valve member 52 being provided with a blind bore that defines the fuel flow path 68. However, it will be appreciated that the control piston 72 and second valve member 52 may equally be formed separately and thereafter rigidly connected end to end in a known manner. For example, the control piston 72 may be adapted to insert into a receiving surface, such as a drilling, in the end of the second valve member 52, and may be fixed in place as an interference fit, using an adhesive, by welding, or by way of a screw thread. In alternative embodiments, the control piston 72 may not be rigidly coupled to the second valve member 52, and in such embodiments the coupling may take another form known to the person skilled in the art, such as described in EP 0995901.

The fuel injector 2 further comprises an actuator housing 98 that houses an actuator 100 within the accumulator volume 70. The actuator 100 is illustrated as a solenoid 80, but it will be appreciated that the actuator 100 could equally take the form of a piezoelectric actuator or a magnetostrictive actuator. The actuator 100 acts upon the control piston 72 to move the second valve member 52 towards or away from the second seating region 56 to control the injection of fuel from the second set of nozzle outlets 58. In the case of a solenoid actuator 80, an armature 82 is provided on the end of the control piston 72 within the accumulator volume 70. The armature 82 may suitably be fixed to the control piston 72 by interference fit and/or welding. In the embodiment depicted the armature 82 mounts around (rather than over) the end of the control piston 72 so as not to block the non-restricted flow passage 76 in the end of the control piston 72. Of course, the armature 82 could equally be mounted onto the end of the control piston 72 provided that a further drilling (or similar) is provided to achieve the function of the non-restricted flow passage 76. The armature 82 may suitably be provided with one or more passages 82*a* (conveniently in the form of drillings) extending axially there-through to provide a mechanism of fluid communication from the bottom side to the top side of the armature 82 in the orientation depicted. The passages 82*a* function to increase the rate of fuel flow from the main body of the accumulator volume 70 to the non-restricted flow passage 76. Thus, although the embodiment shows a pair of passages 82*a*, it will be appreciated the absolute number is not essential. Thus, there may, for example, be between 2 and 10 passages 82*a*, such as 4, 6 or 8. In one advantageous embodiment 6 passages 82*a* are provided. In some embodiments, however, the armature 82 may not be provided with passages 82*a*.

The actuator housing 98 is adapted to define an actuator spring chamber 98*a* in fluid communication with the accumulator volume 70, which is arranged to house an actuator spring 102 in engagement between the top of the armature 82 and the actuator housing 98, so as to bias the armature 82, control piston 72 and second valve member 52 away from the solenoid actuator 80 and towards the second seating region 56. A post 104, which may be an extension of the actuator housing 98 or a separate part fixed thereto, extends centrally through the actuator spring chamber 98*a* and coaxially with the control piston 72 and non-restrictive flow passage 76; and the actuator spring 102 is conveniently located over the post 104. The end of the post 104 facing the accumulator volume 70 provides a piston seating region 78. The post 104 and piston seating region 78 are sized and shaped such that it forms a sealing engagement with the end of the control piston 72 when the solenoid 80 is actuated to lift the second valve member 52 from its seating region 56. In this embodiment, the armature 82 to positioned with its solenoid actuator 80 facing surface (upper surface as depicted) slightly below the top of the piston 72, in order to prevent the armature 82 contacting the pole faces of the solenoid actuator 80. In an alternative embodiment, to achieve a similar effect, the post 104 may extend into the accumulator volume 70 slightly beyond the depth of the actuator spring chamber 98*a* to space the armature 82 from the actuator housing 98 when the control piston 72 is actuated. In this way, the post 104 can act as a movement limiter to limit movement of the control piston 72 and armature 82 against the action of the actuator spring 102 and the armature 82 may then be mounted at the end of the control piston 72.

On de-energizing the solenoid actuator 80, the control piston 72 and thus, the second valve member 52 is returned to its original position in engagement with the second seating region 56 under the action of the actuator spring 102.

It should be appreciated, however, that when the actuator 100 is selected to allow variable levels of opening of the second valve member 52, for example, when the actuator 100 is a piezoelectric actuator, there may be some levels of actuation in which the end of the control piston 72 does not sealingly engage with the piston seating region 78.

When a piezoelectric actuator is used, the piezoelectric stack of the actuator may be provided with a coating of a flexible sealant material, the sealant material having an acceptably low permeability to moisture and fuel. The coating serves to prevent or restrict the ingress of fuel from the accumulator volume 70 into the joints between the individual elements forming the piezoelectric actuator stack, and thus reducing the risk of damage to the actuator stack. Further, as the stack is subject to the compressive load applied by the fuel under pressure, the risk of propagation of cracks is reduced. The actuator stack may be arranged within the fuel injector and coupled to the second valve member 52 is any suitable known manner, for example, as described in EP 0995901.

The fuel injector 2 may be assembled in a known manner. Thus, the actuator housing 98, nozzle body 6 and other components are mounted on a nozzle holder 10 by means of a cap nut 20 which engages the end of the second region 6*b* of the nozzle body 6 adjacent its interconnection with the first region 6*a* thereof. A seal 22 (for example, in the form or an resilient ring, such as an elastomeric sealing ring) may be located between the cap nut 20 and nozzle body 6 to reduce the chance of damage to the cap nut 20 or nozzle body 6 when the cap nut 20 is located onto the nozzle holder 10. The nozzle holder 10 may also include a recess within which an actuator 100 can be housed, if necessary. The nozzle holder 10 and cap nut 20 are engaged with each other in any suitable way, such as a screw-threaded portion.

As shown in the drawings, the fuel supply line 92 conveniently comprises bores, which may be provided in any of the nozzle holder 10, actuator housing 98, nozzle body 6 and other components. In order to ensure that these bores align with one another when the fuel injector 2 is assembled, pins (not shown) may be provided, the pins being received within suitable recesses provided in an abutting surface of an adjacent component (for example, in the nozzle holder 10, actuator housing 98, nozzle body 6).

Since the fuel injection nozzle 4 and fuel injector 2 may operate using different actuators 100 (e.g. a solenoid actuator 80 or a piezoelectric actuator) the nozzle holder 10 and/or actuator housing 98 may conveniently be adapted to receive more than one type of such actuators. For example, the housing volume 12 provided in the nozzle holder 10 for housing the actuator may be larger than required for solenoid actuator 80, in order to alternatively accommodate a (large) piezoelectric actuator if necessary. This is shown most clearly by reference to the non-limiting embodiment of FIG. 3, wherein a spring 14 is located within the nozzle holder 10 to maintain compression on the top and bottom seals, a central rod 16 is provided to stop the spring 14 from buckling, and a wire or conductive strip 18 connects the solenoid coil and the top connector 22 and actuator terminals 24. Other components and mechanisms by which a relatively small actuator 100 may be securely housed within a relatively large housing volume 12 will be readily apparent to the person skilled in the art on a case-by-case basis, and any such alternative components and mechanisms are encompassed within the scope of the present invention.

The fuel injector 2 is arranged in use such that the portion of the nozzle body 6 comprising the first set of nozzle outlets 62 and the second set of nozzle outlets 58 extend into an associated cylinder of an internal combustion engine. In this way, fuel from the first 62 and second 58 sets of nozzle outlets are injected into the same engine cylinder.

A mode of using the fuel injector of FIGS. 3 and 4 will now be illustrated, by way of example, with reference to FIGS. 4 to 7.

In use, as illustrated in FIG. 4, with the fuel injector 2 supplied with fuel under high pressure, and with the solenoid actuator 80 being de-energised, the control piston 72 and second valve member 52 are biased by the actuator spring 102 such that the tip of the second valve member 52 engages the second seating region 56, and delivery of fuel from the second set of apertures does not occur. In this position, the pressure of fuel within the injection control chamber 50 is high, and hence the force acting against the first surface 64 at the end of the first valve member 54 due to the fuel pressure, and also due to the resilience of the spring 84 is sufficient to overcome the counter force acting on the second surface of the first valve member due to the high-pressure fuel (at injection pressure) acting against the angled surfaces of the first valve member 54, such as the angled step 106. Accordingly, the net force applied to the surfaces (64, 106) of the first valve member 54 is sufficient to hold the first valve member 54 in engagement with the first seating region 60, such that injection of fuel also does not take place through the first set of nozzle outlets 62.

In this position, the control piston 72 and, hence, the non-restricted flow passage 76 is spaced from the piston seating region 78 so that the accumulator volume 70 communicates with the injection control chamber 50 through the non-restricted flow passage 76, 68, and through the restricted flow passage 74, 68. Therefore, the fuel pressure within the accumulator 70 is substantially equilibrated with the fuel pressure in the injection control chamber 50, and so any pressure drop along the length of the control piston 72 is minimal, preventing or at least minimising any leakage of fuel between the control piston 72 and the end plate 96 between the control chamber 50 and the accumulator volume 70.

Figure 5A:
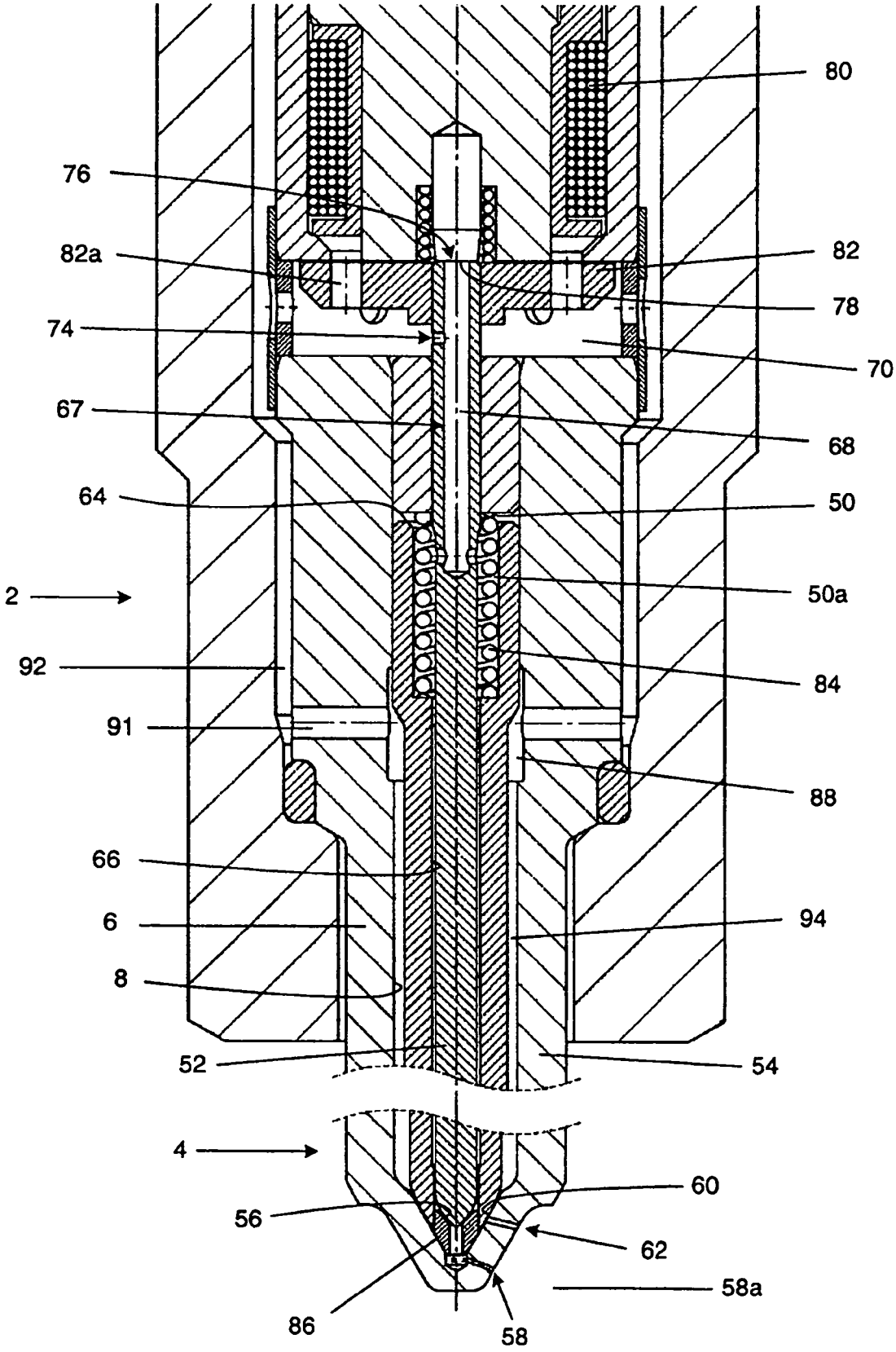
In FIG. 5A the first valve member is actuated to inject fuel through a first set of nozzle outlets.
Figure 5B:
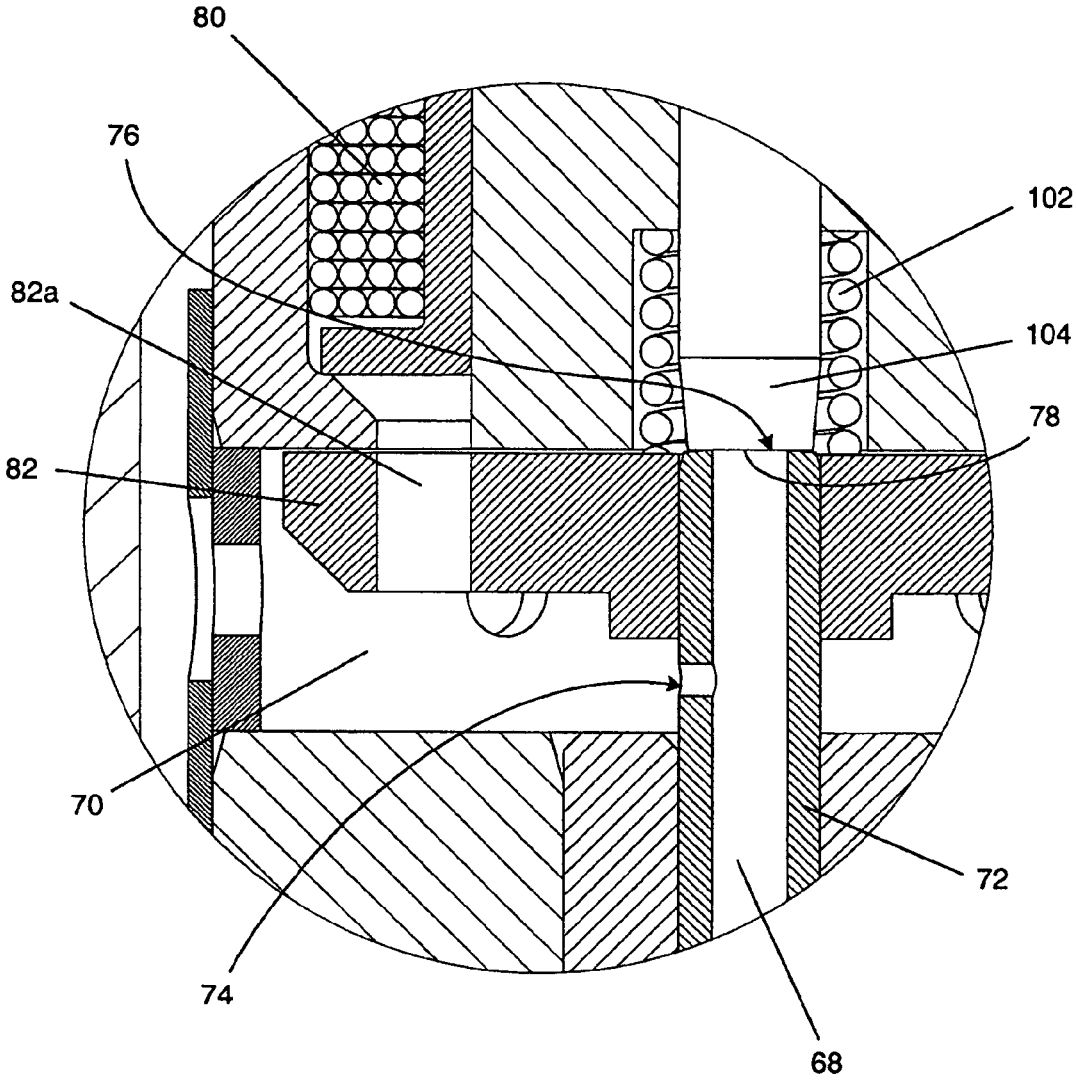
FIG. 5B shows an enlarged view in the region of the accumulator volume of the fuel injector when the first valve member is actuated.

With reference to FIG. 5A and FIG. 5B, in order to initiate a first level of fuel injection into an associated engine cylinder, the solenoid actuator 80 is energised thereby lifting the armature 82 and control piston towards itself. Since the control piston 72 is rigidly coupled to the second valve member 52, the movement of the control piston 72 causes the same movement of the second valve member 52, immediately lifting the tip of the second valve member 52 away from the second seating region 56. The disengagement of the second valve member 52 from its seating region 56 creates a fluid communication path between the fuel in the injection control chamber 50 and the second set of nozzle outlets 58, and allows an injection of fuel 58*a* at injection pressure (i.e. at the pressure of the accumulator volume 70) from the second set of nozzle outlets 58. The fuel for injection is delivered from the injection control chamber 50 (of which the spring chamber 50*a* is a part), causing a rapid drop in the fuel pressure within the injection control chamber 50. In this position, fuel from the first valve bore 66 is prevented from reaching the first set of outlet nozzles 62 by the sealing engagement of the first valve bore 66 against the outer edge of the second valve seat member 86.

In order to reduce or minimise the force required to lift the second valve member the second seating region 56 of the second valve seat member 86 is suitably of a small diameter, for example, less than 0.5 mm. In one embodiment the second seating region has a diameter of approximately 0.4 mm.

As indicated more clearly in FIG. 5B, when the control piston 72 is lifted to its full extent under actuation by the solenoid 80, the end of the control piston 72 within the accumulator volume 70 is brought into engagement with the piston seat 78 of the post 104 thereby closing the non-restricted flow passage 76, 68. Therefore, the accumulator volume 70 communicates with the injection control chamber 50 only via the restricted flow passage 74. The relatively rapid loss of fuel from the injection control chamber 50 caused by the injection of fuel at the second set of nozzle outlets 58, and the restricted communication between the injection control chamber 50 and the accumulator volume 70 causes a reduction in the pressure of the injection control chamber 50 and a pressure drop across the control piston 72.

Figure 6:
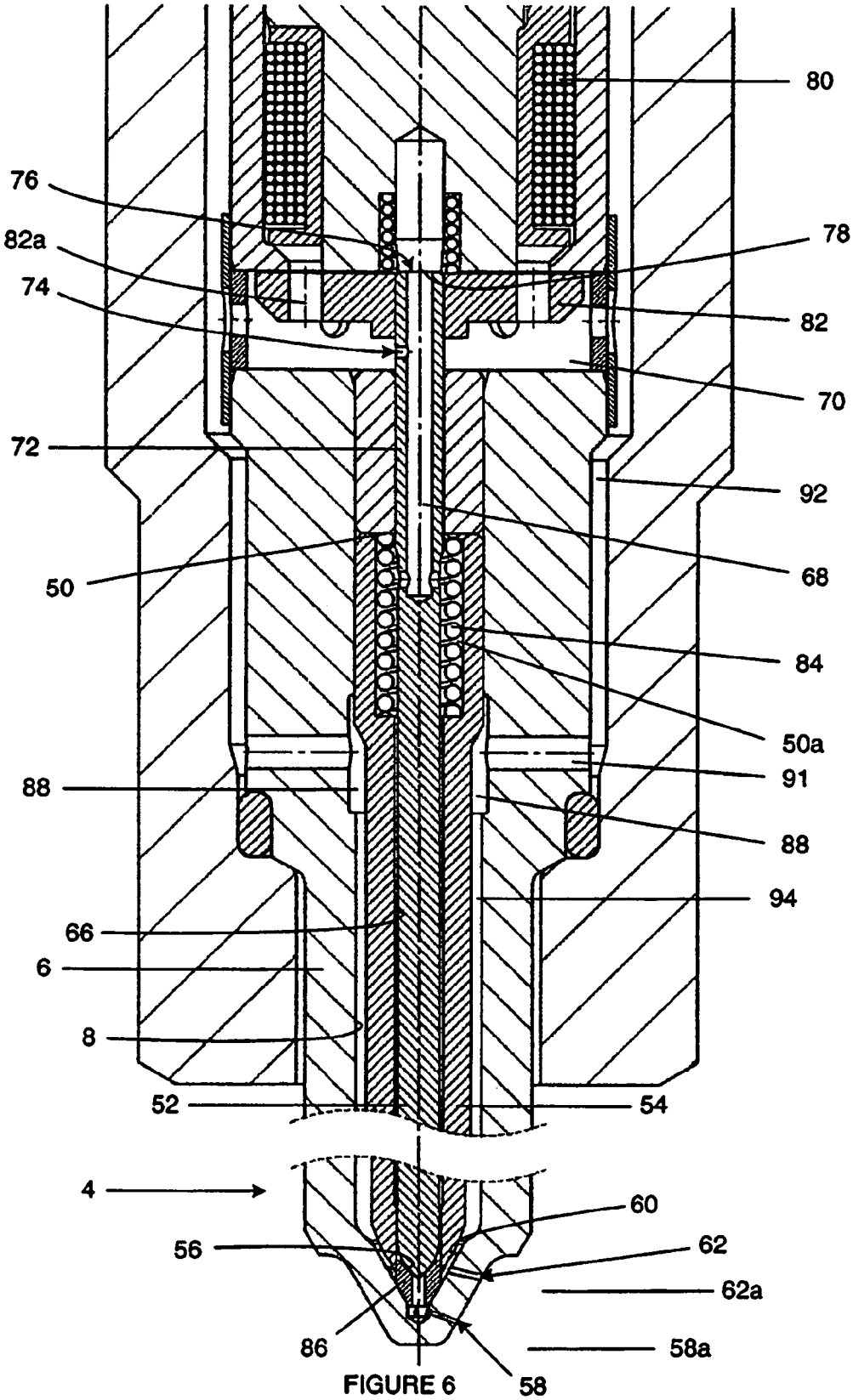
FIG. 6 shows the fuel injector of FIGS. 3 and 4 in a second fuel injecting mode. In this mode the first and second valve members are actuated to inject fuel through first and second sets of nozzle outlets.

As the pressure of fuel in the injection control chamber 50 decreases, the net force on the first surface 64 of the first valve member 54 due to fuel pressure and spring 84 biasing the first valve member 54 against the first seating region 60 reduces. While the solenoid 80 is energised the fuel injection 58*a* continues until a point is reached at which the force of fuel at injection pressure acting against the second surface 106 of the first valve member 54, biasing the first valve member away from the first seating region 60, will become greater than the force on the first surface 64 of the first valve member 54. At this point the first valve member 54 will disengage the first seating region 60 under action of the fuel in annular gallery 88 and passage 94, thus commencing a fuel injection 62*a* from the second set of nozzle outlets 62. In this second mode of fuel injection, fuel is injected from both the first 62 and second 58 sets of nozzle outlets, as shown in FIG. 6.

In contrast to prior art fuel injectors, the "servo" flow of fuel out of the injection control chamber 50 that is required to open the first valve member 54 is injected into a cylinder of an engine, rather than being directed to a low pressure fuel drain. In this way, the first mode of fuel injection is very rapid, such as in a direct acting piezoelectrically actuated fuel injector.

The rate at which the pressure across the control piston 72 drops and the rate at which injected fuel from the injection control chamber 50 is replaced by fuel from the accumulator volume 70 can be controlled by appropriate sizing of the restricted flow passage 74 and the injection control chamber 50. For example, in an advantageous embodiment the injection control volume 50 and/or the restricted flow passage 74 is sized such that the time taken for the pressure of fuel in the injection control chamber 50 to drop sufficiently for the first valve member 54 to lift from the first seating region 60 is longer than the time necessary to perform pilot (pre-) or post-injections associated with a main fuel injection event of the engine. Similarly, the time period may suitably be longer than the time needed to perform fuel injection events when the engine is at idle. Beneficially, the second set of nozzle outlets 58 may be sized optimally for performing pilot and post-injections. It will be appreciated, therefore, that since the lift of the second valve member 52 is directly controlled by the actuator 100, in the first mode of fuel injection precise injection quantity control and closely spaced (rapid) injection events can conveniently be achieved.

Where the actuator 100 is a piezoelectric actuator, the time taken for the fuel pressure in the injection control chamber 50 to fall to a level at which the first valve member 54 disengages from the first seating region 60 may advantageously be controlled (e.g. extended) by de-energising the piezoelectric stack (in a de-energise to inject injector), or energising the piezoelectric stack (in an energise to inject injector), by a relatively small amount so that the second valve member 52 is caused to lift by a relatively small amount (a partial lift mode). Thus, the rate of flow of fuel from the injection control chamber 50 through the first set of nozzle outlets 58 may be restricted, and moreover, the non-restricted flow passage 76 is not fully closed by the piston seat 78. Accordingly, the fuel pressure in the injection control chamber 50 may be maintained at a desired level, or may be caused to reduce at a desirably slow rate, to prolong the period during which injection only occurs through the second set of nozzle outlets 58.

When the actuator 100 is solenoid actuator 80, apart from the above-described modifications to the sizes of the second set of nozzle outlets 58, the volume of the injection control chamber 50 and the size of the restricted flow passage 74, the injection of fuel through only the second set of nozzle outlets 58 may be prolonged by effecting several rapid, short injections events.

In the second mode of fuel injection depicted in FIG. 6 the injected fuel 62*a* from the first set of nozzle outlets 62 is supplied from an accumulator volume via a fuel supply line comprising passages 92, 91 and 94 and the annular gallery 88. Meanwhile, the fuel within the accumulator volume 70 is also maintained at injection pressure via fuel supply line 92. Thus, provided there is a constant supply of fuel from an accumulator volume of the engine, the second mode of fuel injection involving fuel injections 58*a*, 62*a* from both sets of nozzle outlets 58, 62 is maintained as long at the actuator 100 is actuated.

This second mode of fuel injection is particularly suitable for a situation in which a large injection of fuel is required, such as a main fuel injection event, and when the engine is operating at relatively high speed and load. In this mode, the first valve member 54 can readily be lifted by a sufficient amount to provide a substantially unrestricted fuel injection 62*a* from the first set of nozzle outlets 62. The size of the first set of nozzle outlets may also be selected according to fuel injector 2 requirements.

Figure 7A:
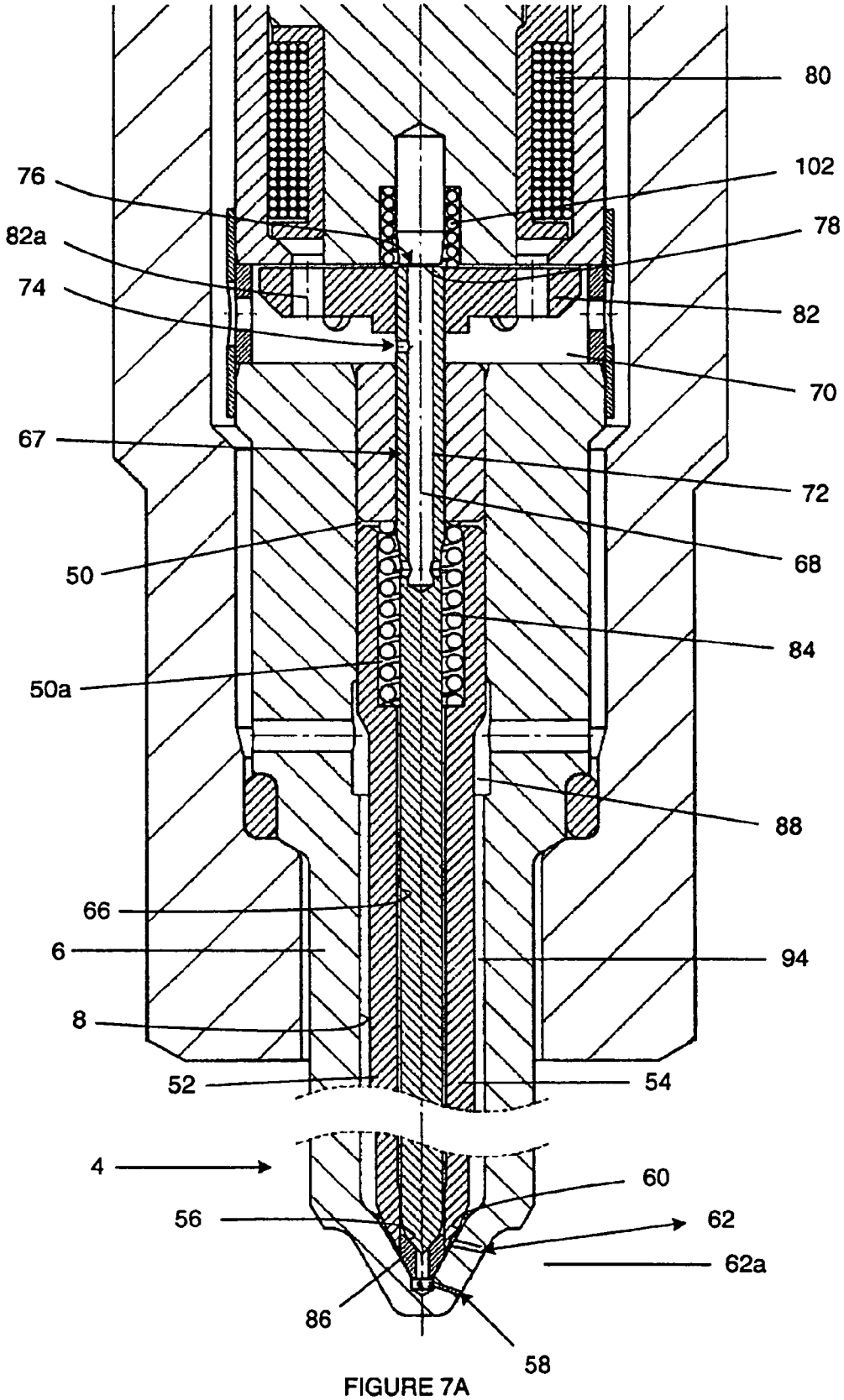
In FIG. 7A the first valve member is deactuated to halt the injection of fuel through the first set of nozzle outlets.
Figure 7B:
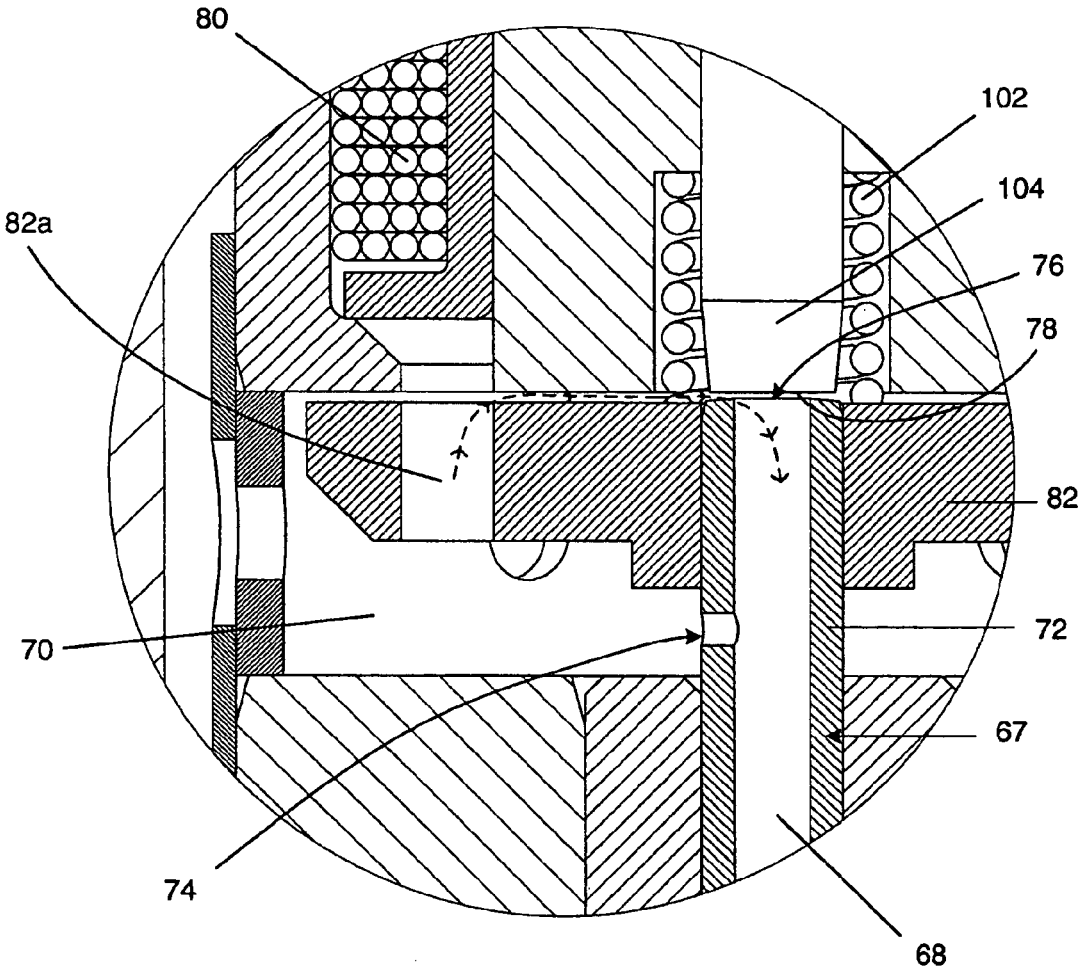
FIG. 7B shows an enlarged view in the region of the accumulator volume of the fuel injector when the first valve member is deactuated.

FIG. 7A and FIG. 7B depict the situation in which the fuel injection event is to be ended. To terminate fuel injection, the solenoid actuator 80 (or other actuator 100 in alternative embodiments) is de-energised to release the armature 82 and control piston 72, and the second valve member 52 thus moves away from the solenoid actuator 80 (i.e. downwards), under the biasing force of the actuator spring 102, until the tip of the second valve member 52 engages the second seating region 56. At this point the fluid communication path between the injection control chamber 50 and the second set of nozzle outlets 58 is closed and the fuel injection 58*a* immediately ends. In addition, the movement of the control piston 72 away from the solenoid actuator 80 causes the non-restricted flow passage 76 to disengage the piston seating region 78, thereby opening up the non-restricted flow passage 76, 68, between the accumulator volume 70 and the injection control chamber 50. The injection control chamber 50 then communicates with the high-pressure fuel within the accumulator volume through both the restricted 74 and non-restricted 76 flow passages and the injection control chamber 50 is rapidly recharged with fuel at injection pressure. When the pressure of fuel within the injection control chamber 50 has reached a sufficiently high level such that the net force acting to on the first surface 64 of the first valve member 54 (due to fuel pressure in the injection control chamber 50, the force of the spring 84, and pressure drops at the first set of nozzle outlets 62) is greater than the force acting on the second surface 106 of the first valve member 54 (due to fuel at injection pressure in annular gallery 88 and passage 94), the second valve member 54 is forced into engagement with the first seating region 60, and the fuel injection 62*a* from the first set of nozzle outlets 62 also terminates.

The bores 82*a* in the armature 82 provide further passages through which high-pressure fuel within the main body of the accumulator volume 70 can enter the non-restricted flow passage 76, and helps to increase the rate at which the injection control chamber 50 is refilled with fuel from the accumulator volume.

While some advantages of the invention will be readily apparent from the above description, other benefits of the invention should be noted.

For example, in a traditional prior art servo-type fuel injector about a 20% pressure drop is typically required in the injection control chamber in order for the valve needle to disengage from its associated valve seating and enable a fuel injection event. The fuel injection event is thus controlled indirectly by an actuator, meaning that response time is slow and the servo flow is parasitic. Further, in such a normal servo injector, the other 80% of the pressure energy is turned into turbulence by the spill orifice leading from the injection control chamber to the low pressure fuel drain, and the energy created ends up as heat in the back-leak. For this reason, a traditional servo design is usually a compromise between the competing requirements of operating the valve needle fairly quickly (which would require a high fuel flow) and the generation of excessive waste heat in the back-leak.

Notably, on some prior art fuel injectors the servo flow to a low pressure drain is only about 15-20% of the flow rate from the nozzle outlets in a fuel injection event. Thus, by injecting the "servo" flow from the injection control chamber 50 directly into an engine cylinder through the second set of nozzle outlets 58 (and using the remaining 80% of the pressure drop to further generate the fuel spray 58*a* into the engine cylinder), the rate of the "servo" flow can be greatly increased (e.g. to up approximately 50% of the total fuel injection rate through nozzle outlets 58 and 62 combined), which can also enable the more rapid opening of the indirectly-actuated first valve member 54, if so required.

For optimum exhaust emissions it is known to be desirable to inject most of the fuel through relatively small nozzle outlets (or spray hole areas), and to only revert to a large spray hole area where high engine powers are required. By suitable sizing of the second set of nozzle outlets 58, the restricted flow passage 74, injection control volume 50 and spring 84, it is possible to delay the opening of the first valve member 54, as previously described, to achieve this aim. For example, by using a relatively high spring 84 load and a relatively large restricted flow passage 74 aperture it is possible to prevent the first valve member opening until a suitably high rail pressure has been reached. Alternatively or additionally, having a relatively large injection control volume 50 can also delay the opening of the first valve member 54 until relatively large quantities of fuel have already flowed through the second set of nozzle outlets 58.

In the fuel injector embodiments of the invention wherein the actuator is a piezoelectric actuator, the injector is most suitably a de-energise to inject injector, in which a fuel injection event is triggered by the discharge of the piezoelectric actuator.

An engine generally comprises a plurality of fuel injectors and, therefore, the methods of the invention may be used to operate a plurality of fuel injectors at the same time, within an engine. Likewise, the invention encompasses engines comprising one or more fuel injectors or injection nozzles of the invention.

It will be appreciated that the various steps of the methods of the invention recited hereinbefore and in the claims need not, in all cases, be performed in the order in which they are introduced, but may be reversed or re-ordered whilst still providing the advantageous associated with the invention.

Although particular embodiments of the invention have been disclosed herein in detail, this has been done by way of example and for the purposes of illustration only. The aforementioned embodiments are not intended to be limiting with respect to the scope of the appended claims, which follow. The choice of actuator for use in a fuel injector of the invention, the exact mechanism for the direct coupling between the actuator and the second valve member (such as the form of the control piston), and the arrangement of nozzle outlets in the same or different regions (i.e. whether the injection nozzles first and second sets of nozzle outlets are the same or different) may be decided on a case by case basis, and such variations are encompassed within the scope of the invention. It is contemplated that various substitutions, alterations, and modifications may be made to the various components of the fuel injectors and injection nozzles without departing from the spirit and scope of the invention as defined by the claims.

The invention claimed is:

1. A fuel injector for use in an internal combustion engine, the fuel injector comprising: an actuator, a first valve member and a second valve member, said second valve member controllable directly by the actuator, an injection control chamber for fuel, and a set of nozzle outlets; wherein actuation of the second valve member controls the fuel pressure within the injection control chamber, and actuation of the first valve member is regulated by the fuel pressure within the injection control chamber; and wherein the fuel injector is arranged such that actuation of the second valve member establishes a fuel flow path between the injection control chamber and the set of nozzle outlets, wherein the first valve member is provided with a first valve bore, and wherein the second valve member is received within the first valve bore.

2. The fuel injector of claim 1, wherein:

the first valve member is engageable with a first seating region to control fuel delivery through a first set of nozzle outlets; and the second valve member is engageable with a second seating region to control fuel delivery through a second set of nozzle outlets.

3. The fuel injector of claim 1, wherein:

the first valve member is responsive to fuel pressure within the injection control chamber and is arranged to control fuel delivery through a first set of nozzle outlets; and the second valve member is responsive to said actuator and is arranged to control fuel delivery through a second set of nozzle outlets.

4. A fuel injector for use in an internal combustion engine, the fuel injector comprising:

an injection nozzle;

a nozzle body provided with a nozzle bore;

an injection control chamber for fuel;

a first valve member being received within the nozzle bore and being engageable with a first seating region to control fuel delivery through a first set of nozzle outlets;

a first surface associated with the first valve member and defining a wall of the injection control chamber;

a second valve member being engageable with a second seating region to control fuel delivery through a second set of nozzle outlets; and an actuator for controlling the position of the second valve member relative to the second seating region;

wherein the fuel injector is arranged such that fuel delivery through the second set of nozzle outlets is controlled by the actuator, and fuel delivery through the first set of nozzle outlets is controlled by the fuel pressure within the injection control chamber, wherein the first valve member is provided with a first valve bore, and wherein the second valve member is received within the first valve bore.

5. The fuel injector of claim 4, wherein in use, fuel from the injection control chamber is delivered through the second set of nozzle outlets causing fuel pressure within the injection control chamber to reduce, and when the pressure of fuel within the injection control chamber has reduced to a predetermined low pressure, the first valve member is caused to disengage the first seating region (60) to allow delivery of fuel through the first set of nozzle outlets.

6. The fuel injector of claim 4, wherein the actuator comprises a solenoid actuator; and wherein the second valve member is coupled to an armature responsive to the energization state of the solenoid actuator.

7. The fuel injector of claim 6, wherein the armature is received within the accumulator volume; and wherein the armature is coupled to the second valve member via a control piston.

8. The fuel injector of claim 4, wherein the actuator comprises a piezoelectric actuator.

9. The fuel injector of claim 8, which further comprises a hydraulic coupling between the piezoelectric actuator and the second valve member.

10. The fuel injector of claim 4, wherein the actuator comprises a magnetostrictive actuator.

11. The fuel injector of claim 4, wherein the first valve member defines a spring chamber within the injection control chamber; and wherein the spring chamber houses a spring serving to bias the first valve member towards the first seating region.

12. The fuel injector of claim 4, which comprises a second valve seat member, the second valve seat member having a surface defining the second seating region.

13. The fuel injector of claim 12, wherein the second valve seat member is arranged to substantially prevent fluid communication between the first set of nozzle outlets and the second set of nozzle outlets.

14. The fuel injector of claim 12, wherein the second valve seat member is arranged to guide the first valve member.

15. A fuel injector for use in an internal combustion engine, the fuel injector comprising:

an injection nozzle;

a nozzle body provided with a nozzle bore;

an injection control chamber for fuel;

a first valve member being received within the nozzle bore and being engageable with a first seating region to control fuel delivery through a first set of nozzle outlets;

a first surface associated with the first valve member and defining a wall of the injection control chamber;

a second valve member being engageable with a second seating region to control fuel delivery through a second set of nozzle outlets; and an actuator for controlling the position of the second valve member relative to the second seating region;

wherein the fuel injector is arranged such that fuel delivery through the second set of nozzle outlets is controlled by the actuator, and fuel delivery through the first set of nozzle outlets is controlled by the fuel pressure within the injection control chamber, wherein the second valve member is coupled to the actuator via a pressure control valve, the pressure control valve being adapted to provide a fuel flow path between the injection control chamber and an accumulator volume provided within the nozzle body.

16. The fuel injector of claim 15, wherein the pressure control valve comprises a control piston, the control piston being provided with a restricted flow passage; and wherein the restricted flow passage fluidly connects the injection control chamber to the accumulator volume.

17. A fuel injector for use in an internal combustion engine, the fuel injector comprising:

an injection nozzle;

a nozzle body provided with a nozzle bore;

an injection control chamber for fuel;

a first valve member being received within the nozzle bore and being engageable with a first seating region to control fuel delivery through a first set of nozzle outlets;

a first surface associated with the first valve member and defining a wall of the injection control chamber;

a second valve member being engageable with a second seating region to control fuel delivery through a second set of nozzle outlets; and an actuator for controlling the position of the second valve member relative to the second seating region;

wherein the fuel injector is arranged such that fuel delivery through the second set of nozzle outlets is controlled by the actuator, and fuel delivery through the first set of nozzle outlets is controlled by the fuel pressure within the injection control chamber, wherein the second valve member is coupled to the actuator via a pressure control valve, the pressure control valve being adapted to provide a fuel flow path between the injection control chamber and an accumulator volume provided within the nozzle body, wherein the pressure control valve comprises a control piston, the control piston being provided with a restricted flow passage; and wherein the restricted flow passage fluidly connects the injection control chamber to the accumulator volume , wherein the control piston is further provided with a non-restricted flow passage for fluidly connecting the injection control chamber to the accumulator volume; the control piston being engageable with a piston seating region provided within the accumulator volume to control fuel delivery from the accumulator volume to the injection control chamber via the non-restricted flow passage; and wherein the fuel injector is arranged such that actuation of the second valve member is required for the control piston to engage the piston seating region and close the non-restricted flow passage.

* * * * *